United States Patent [19]

Klocke

[11] Patent Number: 4,934,675

[45] Date of Patent: Jun. 19, 1990

[54] APPARATUS FOR TEMPORARILY REPAIRING UTILITY POLES OR THE LIKE

[76] Inventor: Gary J. Klocke, 1222 N. Main, Carroll, Iowa 51401

[21] Appl. No.: 342,126

[22] Filed: Apr. 24, 1989

[51] Int. Cl.[5] ..... B25B 1/20

[52] U.S. Cl. ..... 269/45; 269/53; 269/111; 269/120; 269/130

[58] Field of Search ..... 269/36, 37, 43, 45, 269/53, 130–132, 111, 120; 254/132

[56] References Cited

U.S. PATENT DOCUMENTS

| | | | |
|---|---|---|---|
| 1,441,464 | 1/1923 | Watson . | |
| 1,663,433 | 3/1928 | Benson . | |
| 1,992,322 | 2/1935 | Nulf et al. | 81/8.8 |
| 2,754,944 | 7/1956 | Petersen | 189/31.5 |
| 3,224,754 | 12/1965 | Graham | 269/108 |
| 3,785,607 | 1/1974 | Worker et al. | 249/48 |
| 3,901,497 | 8/1975 | Dearman | 269/37 |
| 4,074,897 | 2/1978 | Behn | 269/43 |
| 4,172,684 | 10/1979 | Jenkins | 414/22 |
| 4,515,233 | 5/1985 | Silverstein | 269/130 |
| 4,527,786 | 7/1985 | Hsu | 269/244 |
| 4,706,935 | 11/1987 | Thompson | 254/132 |

*Primary Examiner*—Judy Hartman
*Attorney, Agent, or Firm*—Henderson & Sturm

[57] ABSTRACT

A utility pole repairing apparatus having a first and second rigid elongated member with an adjusting mechanism attached therebetween for selectively adjusting the distance between the first and second rigid elongated members. A holding structure is operatively attached to the first and second members for selectively holding the first and second members up against a utility pole in such a way that it can be so positioned by one person. Third and fourth rigid, elongated members also are provided and have a second adjusting mechanism attached therebetween for selectively adjusting the distance between the third and fourth rigid, elongated members. Chains are also provided for selectively attaching the first and third members together for selectively preventing the first and third members from moving farther apart when so attached and chains are also provided for selectively attaching the second and fourth members together for the same purpose so that once the first, second, third and fourth elongated members are so installed on a utility pole, the first and second adjusting mechanisms can be used to tightly engage the utility pole.

1 Claim, 2 Drawing Sheets

APPARATUS FOR TEMPORARILY REPAIRING UTILITY POLES OR THE LIKE

TECHNICAL FIELD

The present invention relates generally to the repair of utility poles and more particularly to an apparatus which permits one person to quickly and easily repair a broken utility pole temporarily.

BACKGROUND ART

Utility companies, for example those that deliver telephone service and electric power, have service interruptions from time to time. Since these service interruptions normally affect large numbers of people, the utility companies react to such interruptions with a sense of urgency. A common reason for service interruptions is service line breakage. When the service lines break, the most common reason for such breakage is that a utility pole has been broken and the wires are therefore not properly supported.

Utility poles can be broken or otherwise damaged for many reasons but two common reasons are severe weather and vehicular accidents.

In a normal situation where a utility pole is broken, the utility company will call out a crew to replace the pole. If this happens at night when these crews are not normally on duty or if it occurs at a time when the normal service crew is busy on other projects, there is a need for a temporary solution to the problem. While it is true that these utility pole changing crews can be called in at night, that becomes an expensive proposition for the utility company which it tries to avoid if possible.

Normally, the utility company will inspect a broken pole and if it looks like the pole will not cause the service lines to break, it is left overnight and a replacement crew will install a new permanent replacement pole the next day. If the wrong decision is made, service may be interrupted before a new pole is installed. If it appears that action on the pole cannot be delayed, then either a crew is called out or some temporary measures are taken to temporarily hold the utility pole in place or temporarily repair it.

Consequently there is a need for a practical device for temporarily repairing and holding broken utility poles until such utility pole can be permanently replaced.

DISCLOSURE OF THE INVENTION

The present invention relates to a utility pole repairing apparatus having a first and second rigid elongated member with an adjusting mechanism attached therebetween for selectively adjusting the distance between the first and second rigid elongated members. A holding structure is operatively attached to the first and second members for selectively holding the first and second members up against a utility pole in such a way that it can be accomplished by one person. Third and fourth rigid, elongated members also are provided and have a second adjusting mechanism attached therebetween for selectively adjusting the distance between the third and fourth rigid, elongated members. Chains or the like are also provided for selectively attaching the first and third members together for selectively preventing the first and third members from moving farther apart when so attached and chains are also provided for selectively attaching the second and fourth members together for the same purpose so that once the first, second, third and fourth elongated members are so installed on a utility pole, the first and second adjusting mechanisms can be used to tightly engage the utility pole.

An object of the present invention is to provide an improved device for temporary repair of broken utility poles.

Another object of the present invention is to provide an apparatus for temporary repair of broken utility poles which can easily and quickly be used by one person, without the need of the assistance of others.

A further object of the present invention is to provide a repair device of the aforementioned type which can clamp around two adjacent parts of a utility pole at the precise location where it is broken to hold such two parts together.

Another object of the present invention is to provide an apparatus of the aforementioned type which will clamp around the bottom portion of a utility pole for holding the utility pole in whatever position is desired and for moving the bottom of the utility pole by attaching the repair device to a truck or the like having hydraulic cylinder controls thereon.

A still further object of the present invention is to provide an apparatus of the aforementioned type which provides reliable temporary repair at a low cost.

Other objects, advantages, and novel features of the present invention will become apparent from the following detailed description of the invention when considered in conjunction with the accompanying drawings.

BEST MODES FOR CARRYING OUT THE INVENTION

Figures 1, 2, 8, 10:
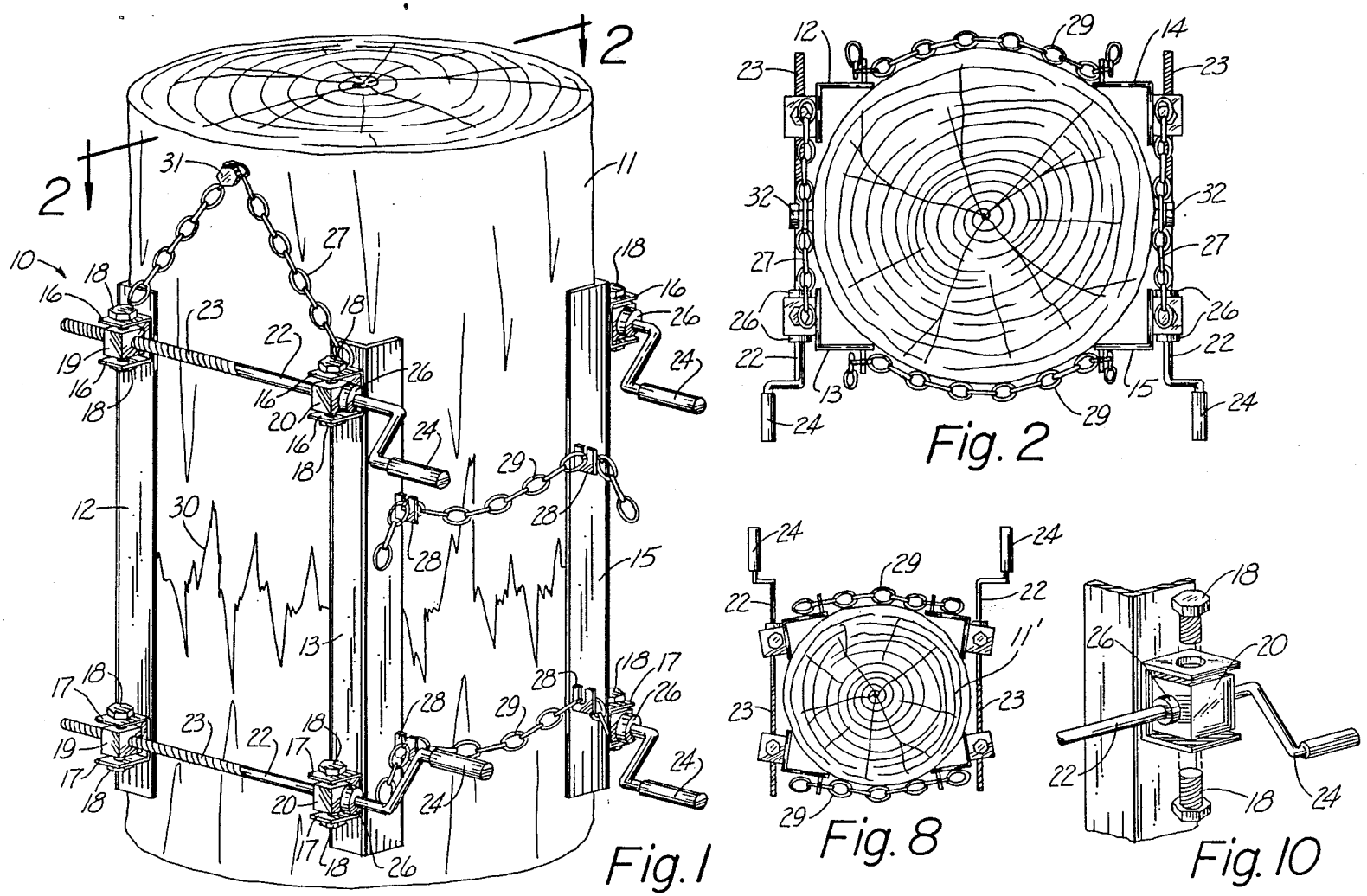
FIG. 1 is a perspective view of a preferred embodiment of the present invention shown attached to a utility pole at the point of breakage for holding the two parts of the utility pole adjacent to the breakage together on a temporary basis.
FIG. 2 is a top view of the preferred embodiment shown in FIG. 1 as seen along line 2—2 of FIG. 1.
FIG. 8 is a view like FIG. 2 but showing the device of FIG. 1 attached to a utility pole which is much smaller than the utility pole shown in FIG. 2.
FIG. 10 is an enlarged partial perspective view showing the top right portion of the device as shown in FIG. 4.

Referring now to the drawings wherein like reference numerals designate identical or corresponding parts throughout the several views, FIG. 1 shows a utility pole repair apparatus (10) constructed in accordance with the present invention and shown attached to a utility pole (11). The utility pole repair apparatus (10) has a first, second, third and fourth rigid, elongated angle iron members (12), (13), (14) and (15), respectively. Each of the rigid elongated members (12–15) have upper pairs of flanges (16) attached thereto and lower pairs of flanges (17) attached thereto. Threaded bolts (18) extend through the flanges (16) and threadably engage metal blocks (19) and (20) on both the top and the bottom as shown in FIG. 1.

The block (19) also has a threaded hole extending therethrough for receiving the threaded shaft (22) which has threads (23) on one end thereof and a hand crank (24) on the other end thereof. Stop collars (26) are rigidly affixed to the shaft (22) on each side of the journal block (20) for allowing the shaft (22) to pivot inside the block (20) but for preventing the shaft (22) from moving longitudinally inside of the bore through journal block (20) (see FIGS. 1 and 10). A chain (27) is held securely to the flanges (16) by the bolts (18) as is best shown in FIG. 1.

Each of the rigid elongated members (12–14) have pairs of slotted flanges (28) attached to the exterior side thereof for receiving chains (29).

The operation of the embodiment shown in FIGS. 1, 2 and 8 is that when a telephone pole (11) has been broken as is shown by the jagged lines (30) in FIG. 1, the user of the utility pole repair apparatus (10) has the chains (29) removed so that the first and second elongated members (12 and 13) with rods (22) interconnecting them can be hung onto the utility pole (11) by first screwing in a lag screw (31) at the proper position (FIG. 1) above the break (30) and hanging one-half of the apparatus (10) on the pole (11).

The the other side of the utility pole apparatus (10) which is on the opposite side from FIG. 1 and including elongated members (14) and (15), is hung on the other side of the pole by utilizing another lag screw (32), which is shown in FIG. 2. This allows the apparatus (10) to be properly positioned by one person, thereby saving the labor costs of a second person.

Once both sides of the apparatus (10) are hung on the lag screws (31) and (32), then the chains (29) are placed in the position shown in FIGS. 1 and 2 for drawing the elongated members (12) and (14) as close together as possible. In like manner, the elongated members (13) and (15) are held as close together as possible by chains (29).

After that has been done, the crank (24) is rotated in a proper direction to draw the elongated members (12) and (13) together, thereby tightening the chains (29). After that is done, the cranks (24) on the other side of the pole (11) are utilized to draw the elongated members (14) and (15) even closer together to thereby tighten the grip on the utility pole (11). Once all of the cranks (24) have been utilized to tighten the four rigid elongated members (12–15) to the utility pole (11) as tightly as possible, the job is done and the temporary repair will hold the utility pole (11) together until such time that a crew can be called to the scene to completely change out the utility pole (11) and replace it with a new one.

It is noted that most utility pole breaks still have the two pieces of the utility pole connected together at the break (30) and if such is the case, there is no need to bring the two pieces of the utility pole (11) together before the above-explained process is utilized, otherwise, the two parts of the utility pole (11) must be moved together before the process can begin.

Figure 3:
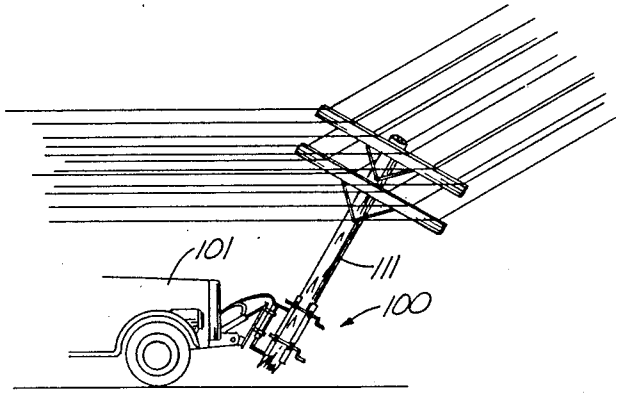
FIG. 3 is a side elevational view of a second preferred embodiment of the present invention shown attached to a truck and showing how it is attached to a utility pole.

Referring now to FIG. 3, it is noted that a second embodiment (100) of the present invention is shown attached to a utility pole (111). A truck (101) having a bumper (102) or other bracket extending therefrom has a frame (103) pivotally attached thereto at pin (104). A pivot hydraulic cylinder (105) is pivotally attached at the bottom thereof to the truck (101) and is pivotally attached at the top thereof to the frame (103) at pin (106).

Figure 9:
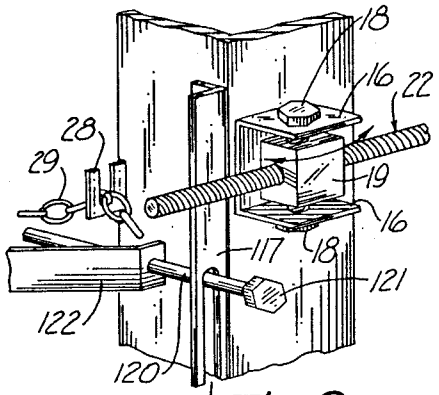
FIG. 9 is an enlarged partial perspective view similar to that of FIG. 7 but showing the top left portion of the device as shown in FIG. 4.
Figure 7:
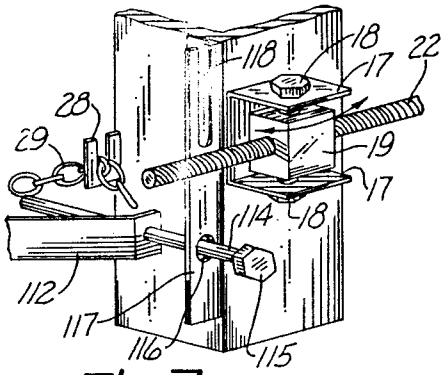
FIG. 7 is an enlarged partial perspective view showing the bottom left portion of the device as shown in FIG. 4.
Figure 6:
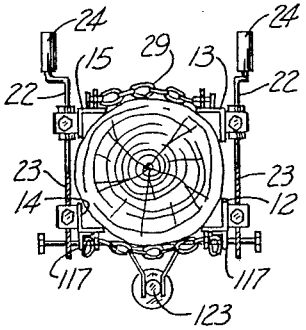
FIG. 6 is a cross sectional view showing the apparatus of FIG. 3 attached to a utility pole taken along line 6—6 of FIG. 5.
Figure 5:
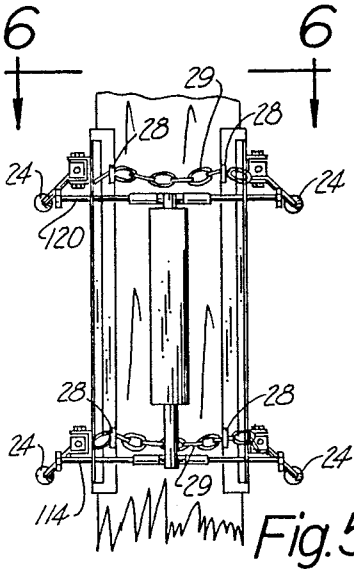
FIG. 5 is a cross sectional view taken along line 5—5 of FIG. 4.

A second lift hydraulic cylinder (107) is rigidly attached to the frame (103) by brackets (108). The bottom of the hydraulic cylinder (107) has a shaft (109) extending therefrom in a conventional fashion, but the bottom of the shaft (109) has a bracket structure (112) rigidly attached thereto as can be seen in part in FIG. 7. This bracket (112) has holes in the end thereof for being slidably received on an elongated shaft (114) having an enlarged head or nut (115) on the end thereof. The shaft (114) extends through a hole (116) in angle iron (117). The angle iron (117) also has an elongated slot (118) disposed therein and, as shown in FIG. 9. A shaft (120) extends through the slot (118) and is slidable up and down in the slot (118). This shaft (120) also has an enlarged head or nut (121) on each end thereof. The shaft (12) extends through brackets (122) which is attached to the top of the hydraulic cylinder at fastener (123) as is shown in FIG. 6.

The operation of the embodiment (100) utility pole repair apparatus is as follows. The apparatus (10), before the utility pole (111) is attached thereto often has the utility pole in the position shown in FIG. 3. In order to attach the apparatus (100) to the utility pole (111), the truck (101) is utilized to drive the apparatus (10) up to and in abutment with the bottom of the utility pole (111). That would leave the apparatus (10) in a vertical position, but in order to align the apparatus (100) with utility pole (111), a tilt cylinder (105) is elongated, in a well-known way by controls inside the truck (101). This will align the apparatus (100) with the utility pole (111).

If it is desired to move the apparatus (100) up or down on the utility pole (111), the lift cylinder (107) is actuated one way or the other in order to move the apparatus (100) up or down. Once it is properly aligned with utility pole (111), the chains (29) are placed in the slotted brackets (28) and the cranks (24) are manually utilized to tightly draw the rigid elongated members (12–15) down tightly against the utility pole (111). It is to be noted that the angle irons (117) on elongated members (12) and (14) allow elongated members (12) and (14) to be moved apart or towards each other to adjust to the size of varying utility poles. The device (100) is also held up by the pin (114) passing through brackets (112), rigidly attached to the hydraulic cylinder shaft (109) and to bracket (117), rigidly attached to elongated members (12) and (14).

Figure 4:
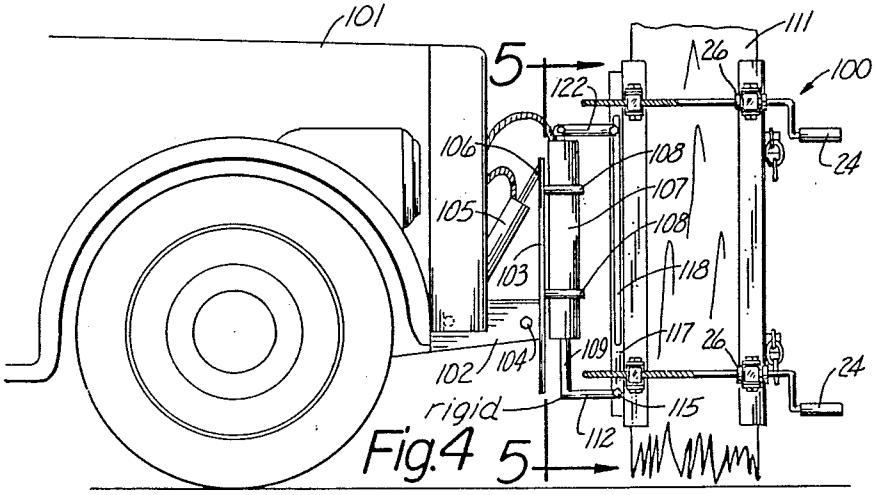
FIG. 4 is a side elevational view of the apparatus shown in FIG. 3 and showing how the tilt cylinder is used to move the utility pole to a vertical position.

On the top thereof, the bracket (122) shown in FIGS. 4 and 9 helps to support the apparatus (100) and keep it aligned with the lift cylinder (107). The pin (120) slides in the slot (118) and while this allows the apparatus (100) to move up and down with respect to the hydraulic cylinder (107), it will hold it parallel to the hydraulic cylinder (107) and prevent it from tipping over.

Once the utility pole (111) is secured to the apparatus (100) then the truck can be moved back and forth, the tilt cylinder (105) can be used to help straighten the utility pole (111) and the lift cylinder (107) can be utilized to move the pole (111) up or down. Ideally then this truck (101), with the apparatus (100) attached to the pole (111), is just left in place on a temporary basis until a permanent crew can come by and change out the pole for a new one. In the meantime, there is no fear that the utility pole (111) will not be held securely in place.

The pivoting of blocks (19 and 20) permit the apparatus (10) and (100) to easily adjust to utility poles of different sizes such as poles (11 and 111) in FIGS. 2 and 8, respectively.

Accordingly it will be appreciated that the preferred embodiments disclosed above do indeed accomplish the aforementioned objects. Obviously, many modifications and variations of the present invention are possible in light of the above teachings. It is therefore to be understood that, within the scope of the appended claims, the invention may be practiced otherwise than as specifically described.

I claim:

1. A utility pole repair apparatus for temporarily stabilizing a fractured utility pole by immobilizing the sections of the utility pole above and below the fracture; wherein, the apparatus comprises:

a first and second rigid elongated members having upper and lower portions wherein the first and second elongated members are operatively secured together by first adjusting means which comprises:

a first shaft having threads on at least one end thereof; first engaging means attached to said first member for threadably engaging said one end of said first shaft; first journal means attached to the other end of said first shaft for permitting said first shaft to rotate; and stop means attached to said first shaft for preventing said first shaft from reciprocating with respect to said first journal means;

a third and fourth rigid elongated member having upper and lower portions wherein the third and fourth elongated members are operatively secured together by second adjusting means which comprise: a second shaft having threads on at least one end thereof; second engaging means attached to said second member for threadably engaging said one end of said second shaft; second journal means attached to the other end of said second shaft for permitting said second shaft to rotate; and, stop means attached to said second shaft for preventing said second shaft from reciprocating with respect to said second journal means; wherein all of said journal means are mounted on opposite ends of the shafts to allow for an angular disposition between said journal means and said shafts;

receiving means provided on the upper and lower portions of said first, second, third and fourth rigid elongated members;

flexible attachment means adapted to be releasably received in said receiving means for attaching the upper and lower portions of both said first and third elongated rigid members and the second and fourth elongated rigid members together; and, holding means operatively attached to the upper portions respectively of the first and second rigid elongated members, and the third and fourth rigid elongated members so that the said rigid elongated members traverse and collectively surround the fracture in said utility pole; wherein, said holding means are suspended from the section of the utility pole which is disposed above said fracture.

* * * * *